US005732894A

United States Patent [19]

Sheahan

[11] Patent Number: 5,732,894

[45] Date of Patent: Mar. 31, 1998

[54] MICRONIZATION APPARATUS AND METHOD

[76] Inventor: Richard T. Sheahan, 83 Shipwright St., Annapolis, Md. 21401

[21] Appl. No.: 556,100

[22] Filed: Nov. 9, 1995

[51] Int. Cl.[6] ..... B02C 19/00

[52] U.S. Cl. ..... 241/56; 241/154; 241/162; 241/186.2; 241/275

[58] Field of Search ..... 241/56, 57, 154, 241/155, 162, 186.2, 275

[56] References Cited

U.S. PATENT DOCUMENTS

| | | | |
|---|---|---|---|
| 248,923 | 11/1881 | Dechamp . | |
| 256,570 | 4/1882 | Hoyt et al. . | |
| 1,636,033 | 7/1927 | Agnew . | |
| 1,713,297 | 5/1929 | Olston . | |
| 2,044,480 | 6/1936 | Lord | 241/162 |
| 4,531,461 | 7/1985 | Sayler et al. | 110/106 |
| 4,690,338 | 9/1987 | Sayler et al. | 241/56 |
| 4,747,550 | 5/1988 | Jackering | 241/55 |
| 4,886,216 | 12/1989 | Goble | 241/275 X |
| 5,542,615 | 8/1996 | Yu et al. | 241/57 |

*Primary Examiner*—John M. Husar

*Attorney, Agent, or Firm*—Tarolli, Sundheim, Covell, Tummino & Szabo; Calvin G. Covell

[57] ABSTRACT

A micronizer includes a housing having a chamber in which a vertical array of impeller discs is disposed. Impact members are disposed on the impeller discs. One, or more, of the impellers have impact members that overhang circular peripheral edges of the impeller discs. The rotational speed of the array of impeller discs may be varied by adjusting the speed of a variable drive motor. The rate of air flow through the array of impeller discs may be varied by adjusting the speed of a fan, which is independent of the speed of the array drive. A plurality of air deflector plates mechanically cause downward force vectors to deflect a combined pulverulent air-material mixture downwardly toward said rotating impact members.

31 Claims, 4 Drawing Sheets

MICRONIZATION APPARATUS AND METHOD

BACKGROUND OF THE INVENTION

This invention relates to a new and improved pulverizing apparatus, and more particularly to an apparatus for grinding and classifying coal to produce micronized coal.

BACKGROUND DESCRIPTION OF THE INVENTION

The apparatus consists of a multi-staged chamber having adjustable components to alter equipment configuration in response to variations in coal hardness and other characteristics. The apparatus entails the combination of a cylindrical vessel with top, side and bottom walls, a series of rotating discs to which are mounted impact blocks, a vertical rotable shaft, and a common casing being constructed in sections for ease of installation, maintenance and interchangeability of equipment components.

Micronized coal is coal that is pulverized to a very fine consistency having micron-sized particles. Because micronized coal is so fine, a unit weight of the material has about three times more fuel surface than conventional pulverized coal, and over five times more particles. This greater surface area causes micronized coal to burn more efficiently and with a more compact flame size and shape, as compared to conventional coal combustion technologies.

The unique combustion advantages of micronized coal gives it important energy conservation applications. Because of its very fine consistency, micronized coal can be burned with less excess combustion air and is able to achieve superior carbon burnout during combustion. These attributes translate into higher combustion efficiency; which means, that the same amount of useful energy can be produced with less coal, as compared to conventional coal burning technologies.

The unique combustion advantages of micronized coal also gives it important environmental advantages. Conventional coal cleaning technologies located at the mouth of coal mines, typically use the forces of gravity and differences in specific weights of a coal's components to separate ash and sulfur from the basic coal content.

It has long been known that a greater liberation, or cleaning, of ash and sulfur is possible, if coal particles are reduced to an extremely fine size to expose more impurities. However, with extremely fine particle sizing, the forces of gravity are not effective for separation; therefore, advanced technologies involving magnetic or electrostatic forces are being developed to achieve greater separation of sulfur and ash from coal.

Therefore, a coal micronization system as described in this invention, could be positioned inside a powerplant; wherein, (a). its micronized coal output could be fed into the inlet of a magnetic or electrostatic separator device, (b). sulfur and ash content would be reduced by magnetic or electrostatic forces, and (c). the cleaned micronized coal would continue its conveyance to a burner of known design and use. The resulting reduction of sulfur dioxide and particulate dust air Missions would produce important environmental benefits.

Additionally, because micronized coal requires less excess air to complete combustion, its produces less nitrogen oxide air emissions. Also, because of its very fine particle size, burning micronized coal results in superior carbon burnout; therefore, yielding less carbon monoxide air emissions. Likewise, because less coal is burned to produce the same amount of useful energy, less carbon dioxide air emissions are produced, as compared to conventional coal combustion.

Thus there are important applications for using micronized coal with industrial and utility boiler and heat producing facilities, that result in important energy conservation and environmental benefits.

This invention addresses only the micronization apparatus. In normal operation, the apparatus is connected to a transport pipe and burner of known design and use. The transport pipe conveys the micronized coal from the apparatus to the burner. The burner uses known design to mix combustion air with the micronized coal to create a heat producing flame.

Throughout this invention description and claims herein, reference will be made to the use of coal as the material which is being micronized; however, it is understood that coal is merely an example of other materials which may also be used, for example, materials such as: activated carbon, petroleum coke, fluid coke, wood, biomass materials, and other fuel related materials.

In a micronization apparatus, the rotational speed of its impactors must correspond with an optimal air flow throughput rate to achieve an optimal micronized particle size distribution, so that:

(a). There must be adequate rotational speed of the impactors to cause sufficient impaction forces to produce micronization of the coal.

(b). There must be an optimal air flow rate to transport the coal particles through the apparatus, while simultaneously allowing an adequate residency time for the coal to be repeatedly impacted with sequentially and sufficient forces to cause particle disintegration, while simultaneously and promptly removing fine particles when they reach an acceptably small size. The air flow rate cannot be too swift; otherwise, unacceptably large particles are produced as a result of insufficient residency time. The air flow rate cannot be too slow; otherwise, an unacceptably long residency time results causing smaller particles to interfere with the ongoing reduction of larger particles causing a needless waste of energy through further impactions and/or a plugging-Up of the apparatus caused by an internal excess build-up of material.

Many prior patents using centrifugal and impaction forces have been proposed and built for the pulverization and micronization of materials. Similar features that exist in these systems include: cylindrical shell housing, centrally positioned rotatable central vertical shaft, horizontal impeller disc plates which support impact blocks and is affixed to the central shaft, and internal cone-like constructions that feed material from the outer periphery of an upper impeller disc to the central portion of an impeller disc there next below. Such prior patents that include all, or most, of these features include: Dechamp U.S. Pat. No. 248,923, (November 1881), Hoyt U.S. Pat. No. 256,570 (April 1882), Agnew U.S. Pat. No. 1,636,033 (July 1927), Oston U.S. Pat. No. 1,713,297 (May 1929), Sayler U.S. Pat. No. 4,690,338 (Sep. 1, 1987).

A common feature of these prior patents is the use an internal fan affixed to the centrally positioned vertical shaft, or use of the rotating impact blocks to create a fan-like effect, to produce air flow through the apparatus to carry the pulverulent material from impeller to impeller and eventually to the apparatus' exhaust. Thus, their fans, or their impactors creating a fan-like effect, rotate concurrent with and at the same speed as the rotating impellers. Therefore, at a particular rotor speed that may be ideal for achieving optimum impaction forces for pulverization or micronization, there is no functional method to control the rate of air flow, and thus achieve an optimum residency time.

Several of the prior art patents describe the use of dampers to regulate the rate of air flow. However, dampers have proved impractical and inoperable because they cannot accommodate air flow changes that result from the combined pulverulent air-coal mixture density differences which varies as the throughput quantity of coal varies.

As coal throughput increases in the apparatus, the combined pulverulent air-coal mixture density increases; correspondingly, as coal throughput decreases in the apparatus, the combined pulverulent air-coal mixture density decreases.

As the density of the combined pulverulent air-coal mixture varies, it causes a comparable variable pressure loss through the apparatus. Likewise, a comparable variable pressure loss is also experienced in the connecting transport pipe and its fittings, in addition to the connected burner of known design and use.

The variable pressure losses in the apparatus, transport pipe and fittings, and burner, conversely, will cause a change in the rate of air flow through the apparatus; thus, making it impossible to maintain an optimal residency time with an internal fan affixed to the centrally positioned vertical shaft, or use of the rotating impact blocks to create a fan-like effect, as is prevalent in prior art patents. This is especially troublesome when such apparatus' are used with utility or industrial boilers, and industrial process heat applications; wherein, varying electrical and heat loads require varying coal-fuel input rates.

With the foregoing in mind, this invention eliminates the indicated disadvantages of prior art.

OBJECTIVE OF THIS PATENT

The kinetic energy or impact momentum of moving materials and particles is proportional to its mass multiplied by the square of its velocity. Therefore, coarse coal particles are more affected by the shattering impact forces of rotating impactors, of which this force materially increases as rotor speed increases. As coal particles become finer and diminish into micronized size, their mass is reduced so that the effects of impact momentum becomes minimal; whereas instead, the predominant affecting forces become those related to air resistance and flow. Finer coal particles are retarded by any relative body or cushion of air; likewise, finer particles are more readily moved by aerodynamic drag forces.

In the micronization of coal, and other friable materials, there are many factors which adversely affect the efficiency and capability of an apparatus to produce a true micronized product, including the coal's chemical and physical structure, its petrologic origin, ratio of mass to weight, size of feed material, rate of feed material, and other criteria, any or all of which can affect the power consumption needed by the apparatus to micronize.

In any pulverizing or micronizing process, hardness of coal is one of the most important fundamental factors that affects grindability. A harder coal is more difficult to micronize than a softer coal. A method of testing to determine the grindability index of a coal is according to the ASTM Standard D-409, or commonly related as the Hardgrove Index which indicates hardness in relation to a standard reference coal. For orientation, the generalized coal hardness categories related to Hardgrove Index ranges and estimated coal reserves in the United States are estimated to be:

| | HARDGROVE RANGE | ESTIMATED PERCENT OF U.S. RESERVES |
|---|---|---|
| Soft | >70 | 20% |
| Medium hard | 50 to 70 | 50% |
| Very hard | <50 | 30% |

It should be noted that the Hardgrove Index is highly non-linear, a change from 100 to 90 being far less critical on the apparatus capabilities than a change from 50 to 40.

Another key characteristic of coal that affects the process of it being micronized is specific gravity since its relates to the magnitude of impact forces, centrifugal forces, and gravitational pull through the apparatus.

The key to a successful micronization apparatus is one that can control and maintain an optimum residency time for coal pieces to be repeatedly impacted with sequentially and sufficient forces to cause particle disintegration, while simultaneously and promptly removing fine particles when they reach micronized size so they will not interfere with the ongoing reduction of larger particles and waste energy needlessly through further impactions and frictional losses.

Therefore, the apparatus must have sufficient flexibility to control the number of coal particle impactions, which is dictated by the coal's residency time within the apparatus as controlled by the air flow rate through the apparatus.

Furthermore, for very hard coals, typically a certain percentage of the coal's mineral constituents are sufficiently hard that they must be subjected to extraordinarily high impact forces to achieve micronization, which means higher rotational impactor speeds.

An objective of this invention, is to provide a means of producing micronized coal within the confines of a single apparatus which is economical to manufacture and assemble, easy to maintain, low in power consumption and efficient to operate.

A further objective of this invention, is to create a micronization apparatus able to maintain a fixed rotational speed that is predetermined based on the hardness and other characteristics of the coal being micronized.

A further objective of this invention, is to create an apparatus able to maintain a fixed air flow throughput that is predetermined based on the hardness and other characteristics of the coal being micronized.

A further objective of this invention, is to create an apparatus able to maintain a constant predetermined air flow rate in response to varying densities of the combined pulverulent air-coal mixture, which causes a comparable variable pressure loss within the apparatus, connecting transport pipe and its fittings, and burner of known design and use.

A further objective of this invention, is to provide a mechanical means to achieve particle classification within confines of the apparatus which allows coarse particles to be retained by forces of impact momentum, thus experiencing additional residency time and impactions; whereas, finer particles pass through and exit the apparatus brought about by aerodynamic drag forces.

With these and other objectives in view, as will be apparent to those skilled in the art, this invention resides in the combination of parts set forth in the specification and covered by the claims appended hereto.

Referring to the drawings illustrating an embodiment of the invention, and in which like reference numerals and letters indicate like parts.

BRIEF DESCRIPTION OF THE DRAWINGS

The foregoing and other features of the present invention will become more apparent upon a consideration of the following description taken in connection with the accompanying drawings, wherein.

DESCRIPTION OF SPECIFIC PREFERRED EMBODIMENTS OF THE INVENTION

Apparatus Housing

Figure 1:
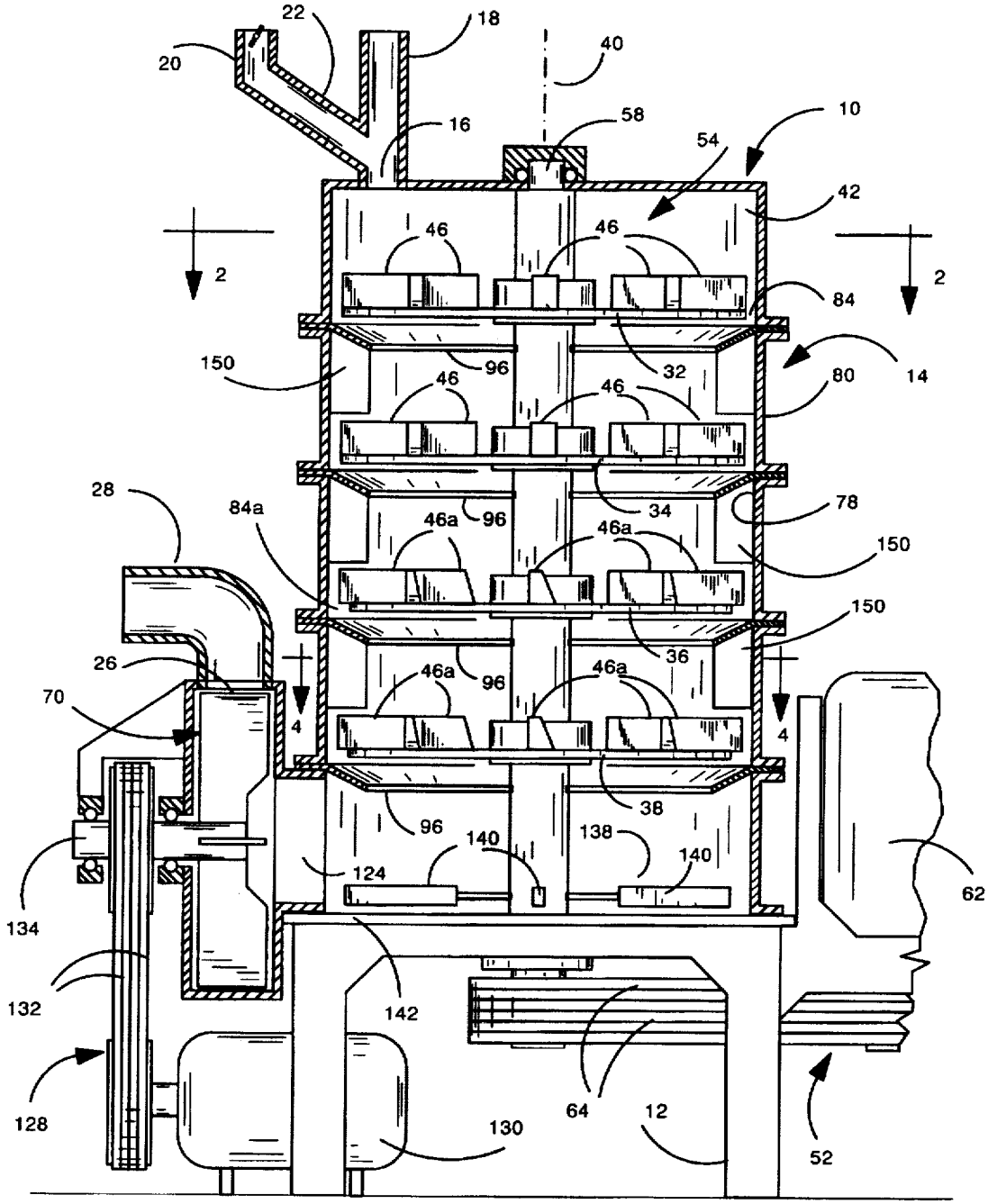
FIG. 1 is a somewhat schematicized sectional view of a micronization apparatus constructed in accordance with the present invention.
Figure 2:
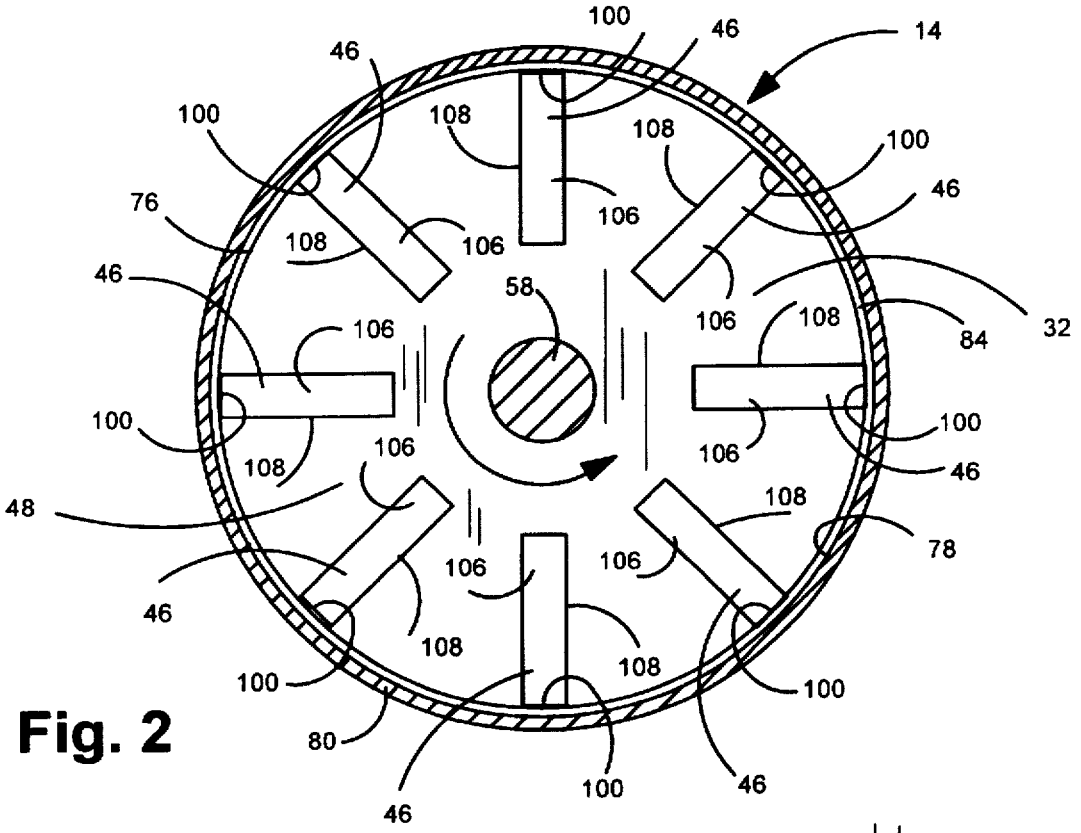
FIG. 2 is a sectional view, taken generally along the line 2—2 of FIG. 1, illustrating the relationship of the top impeller disc and impact members to a side wall of a housing in which the array of impeller discs is disposed.

A micronizer apparatus 10 constructed in accordance with one embodiment of the present invention is illustrated in FIG. 1 and may be utilized to micronize many different materials. The micronizer apparatus 10 includes a base 12 upon which a cylindrical housing 14 is mounted. The housing 14 has an inlet 16 through which air and material to be micronized are conducted into the housing.

In the illustrated embodiment of the invention, the housing inlet 16 is connected in fluid communication with a conduit section 18 through which material to be micronized is conducted downwardly to the housing inlet. In addition, the housing inlet 16 is connected in fluid communication with a conduit section 20 through which a flow of air is conducted to the housing inlet. Although the air and material to be micronized are conducted through the same housing 16, it is contemplated that they could be conducted through separate inlets to the housing 14 if desired. In fact, it may be preferred to have two separate inlet opening, that is, one for the material to be micronized and one for air.

The housing 14 has an outlet 26 through which air and micronized materials are conducted. Thus, the outlet 26 is connected in fluid communication with an outlet conduit 28. A flow of air with micronized materials entrained therein is conducted away from the housing 14 through the conduit 28 to a burner (not shown) of known design and use.

Impeller Discs, Impactors and Deflection Cones

A plurality of circular impeller discs 32, 34, 36, and 38 are disposed in an array along a vertical central axis 40 of a cylinder chamber 42 in the housing 14. The impeller discs 32, 34, 36 and 38 are disposed in a vertical array 54 and spaced equal distances apart along the central axis 40.

A plurality of identical impact members 46 are disposed on flat horizontal facing major upper side surface 48 of impeller disc 32 (FIGS. 1, 2, 3 & 6).

A plurality of identical impact members **46*a* are disposed on flat horizontal facing major upper side surface 48*a* of impeller disc 38 (FIGS. 1, 4, 5 & 7**).

A plurality of impact members, either 46 or **46*a*, are disposed on the upper side surface 48 or 48*a* of impeller discs 34 and 36**.

The impact members 46 and **46*a* disposed on the horizontal upper side surfaces 48 or 48*a* of the impeller discs 32, 34, 36 and 38 have central axes which are aligned with radians of the impeller discs. Thus, the central axes of the impact members 46 and 46*a* have equal angles between them and intersect at the central axis 40 of the chamber 42 and a drive shaft 58**.

Impact members 46 extend radially outwardly to outer end portions 100 (FIGS. 2, 3 & 6) and impact members **46*a* extend radially outwardly to outer end portions 100*a* (FIGS. 4, 5 & 7), which are disposed closely adjacent to a smooth cylindrical inner side surface 78 of a housing side wall 80. However, there is a sufficient clearance distance 102 between the outer end portions 100 and 100*a* of the impact members 46 and 46*a* and the smooth cylindrical inner side surface 78 of the housing side wall 80 to prevent engagement of the impact members 46 and 46*a* with the housing side wall 80**.

Figure 3:
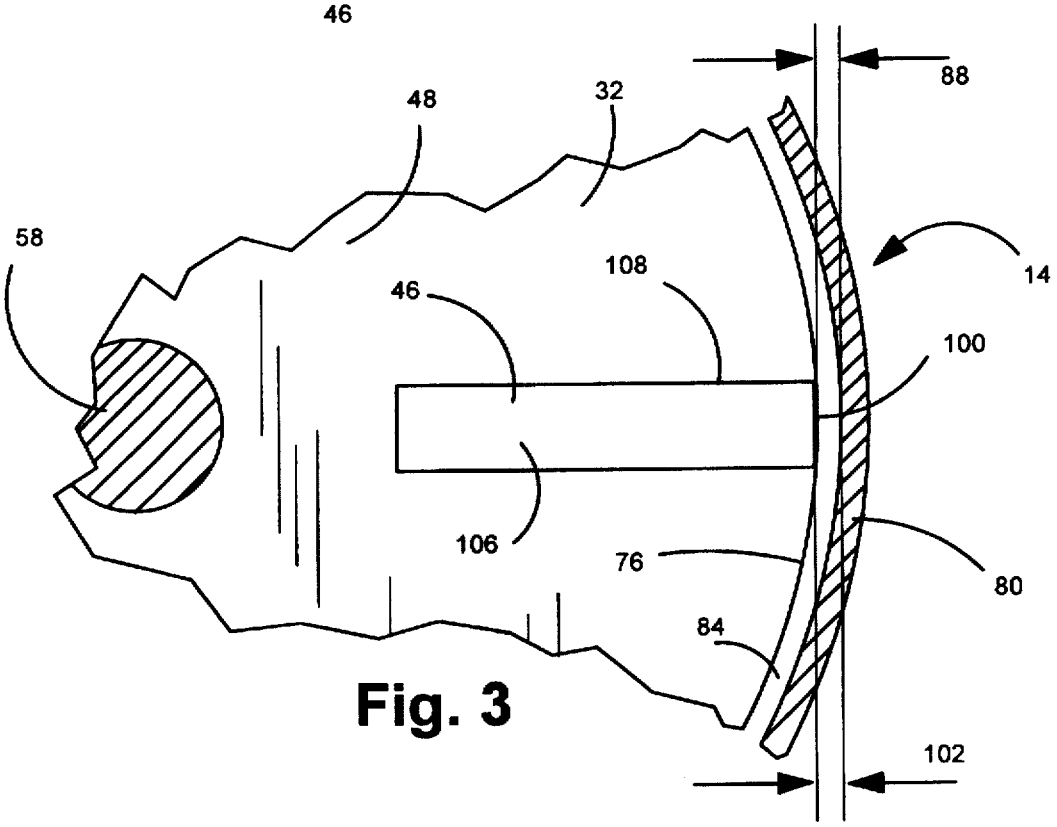
FIG. 3 is an enlarged fragmentary illustration of a portion of FIG. 2 further illustrating the relationship between the impeller disc, impact members and the housing wall.
Figure 4:
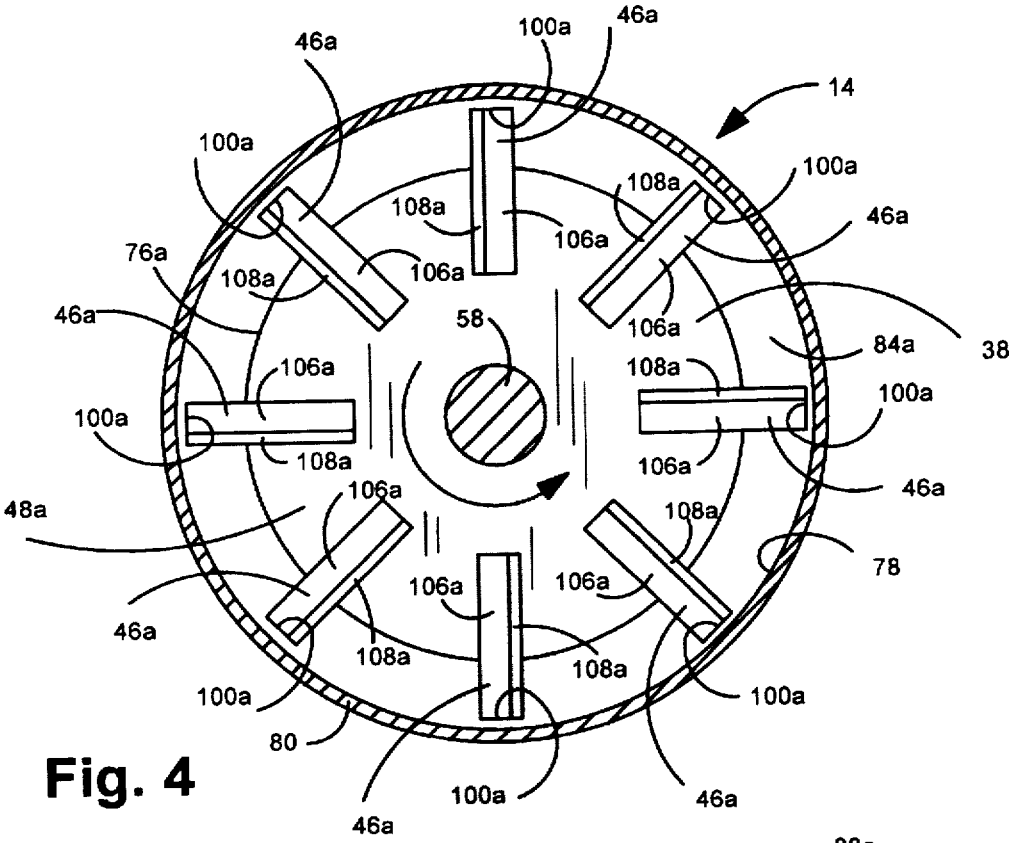
FIG. 4 is a sectional view, taken generally along the line 4—4 of FIG. 1, illustrating the relationship of the bottom impeller disc and impact members to the side wall of the housing in which the array of impeller discs is disposed.
Figure 6:
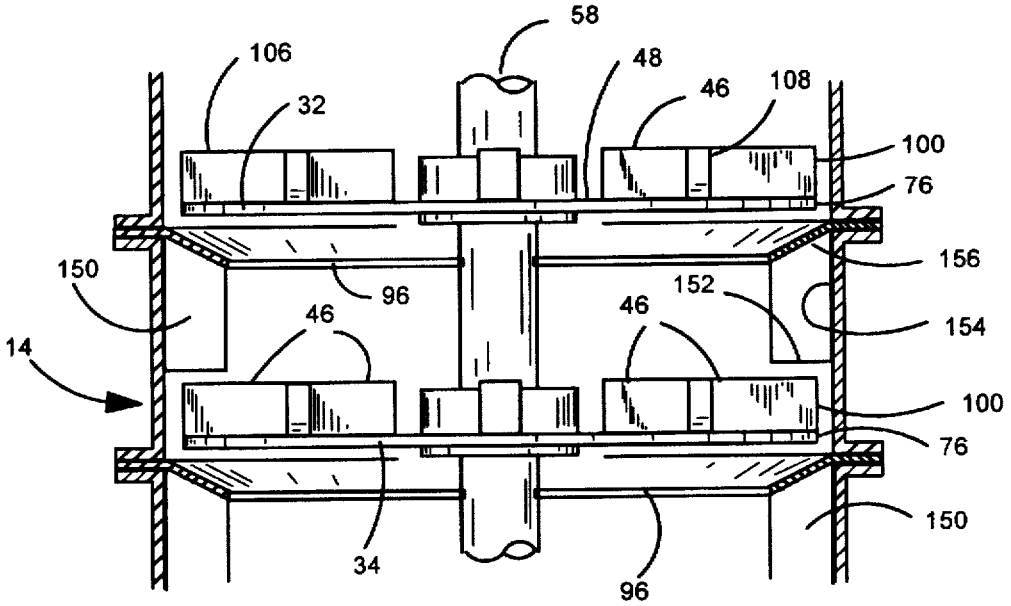
FIG. 6 is an enlarged fragmentary illustration of a portion of FIG. 1 further illustrating the relationship between the top impeller disc, impact members, deflector cones, and air deflector plates.

The uppermost impeller disc 32 extends outwardly from the drive shaft 58 to a circular peripheral edge portion 76 (FIG. 3 & 6). The circular peripheral edge portion 76 of the impeller disc 32 is coaxial with and spaced apart from the smooth cylindrical inner side surface 78 of the housing side wall 80 of the housing 14 by a clearance distance 88. The cylindrical inner side surface 78 of the housing side wall 80 is coaxial with the impeller disc 32 and drive shaft 58. Therefore, there is a uniform annular space 84 (FIG. 3) between the circular peripheral edge portion 76 of the impeller disc 32 and the cylindrical inner side surface 78 of the housing side wall 80.

Figure 5:
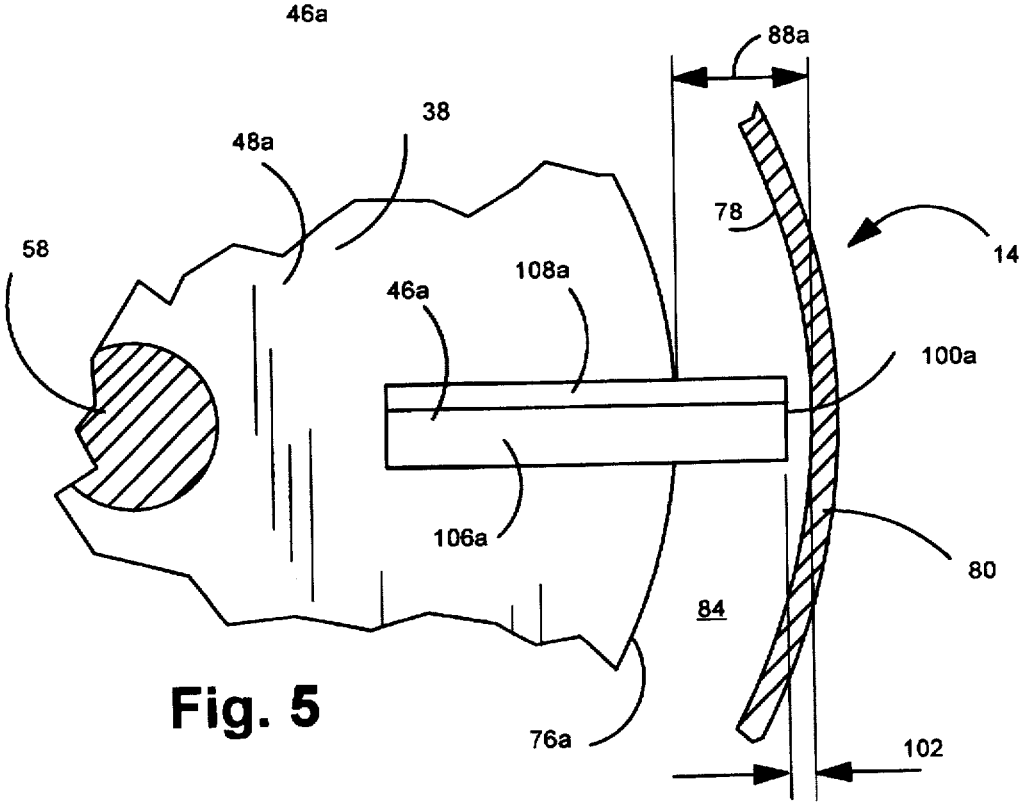
FIG. 5 is an enlarged fragmentary illustration of a portion of FIG. 4 further illustrating the relationship between the impeller disc, impact members and the housing wall.
Figure 7:
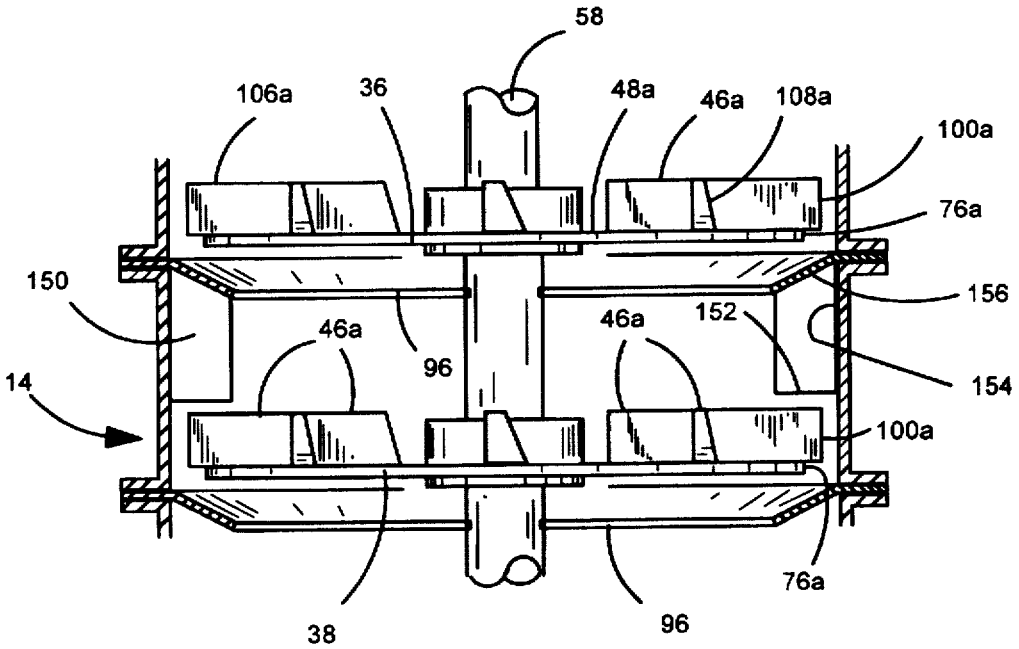
FIG. 7 is an enlarged fragmentary illustration of a portion of FIG. 1 further illustrating the relationship between the bottom impeller disc, impact members, deflector cones, and air deflector plates.

The lowermost impeller disc 38 extends outwardly from the drive shaft 58 to a circular peripheral edge portion **76*a* (FIG. 5 & 7). The circular peripheral edge portion 76*a* of the impeller disc 38 is coaxial with and spaced apart from the smooth cylindrical inner side surface 78 by a clearance distance 88*a*. The cylindrical inner side surface 78 of the housing side wall 80 is coaxial with the impeller disc 38 and drive shaft 58. Therefore, there is a uniform annular space 84*a* (FIG. 5) between the circular peripheral edge portion 76*a* of the impeller disc 38 and the cylindrical inner side surface 78 of the housing side wall 80. Thus, the outer end portions 100*a* of the impact members 46*a* overhang the circular peripheral edge portion 76*a* of impeller disc 38. It is believed that the clearance distance 88*a* (FIG. 5**) is advantageously between one-quarter and two inches, depending on the type and nature of coal being micronized.

Although the foregoing description has been in conjunction with the upper impeller disc 32 and lower impeller disc 38, it should be understood that, depending on the type and nature of coal being micronized, impeller discs 34 and 36 may have the same construction as either impeller disc 32 or impeller disc 38.

For illustrative purposes only in this description, impeller discs 38 and 36 are shown being the same; whereas, impeller discs 32 and 34 are shown being the same.

During operation of the micronizer apparatus 10, air with particles of coal entrained therein, flows radially outwardly along the upper side surface 48 of the impeller disc 32. The air and particles of material then flow downwardly around the circular peripheral edge portion 76 of the impeller disc through the annular space 84.

Since the impact members 46 extend radially to the peripheral edge portion 76 of the impeller disc 32 (FIG. 3), the impact members 46 collide with particles as they move toward the annular space 84. The impact members 46 extend into close proximity to the smooth cylindrical inner side surface 78 of the side wall 80 at a distance which is equal to the clearance distance 102. This prevents the particles of material from moving across or around the ends of the impact members 46.

The clearance distance 102 between the outer end portions 100 and 100*a* of the impact members 46 and 46*a* and the smooth cylindrical surface 78 of the housing side wall 80 is minimized to prevent movement of particles around the outer end portions 100 and 100*a* of the impact members 46 and 46*a*. However, the clearance distance 102 must be sufficient to enable the micronizer apparatus 10 to be constructed with economically feasible tolerances. If desired, the outer end portions 100 and 100*a* of the impact members 46 and 46*a* could be rounded to have a radius which corresponds to the radius of the smooth cylindrical inner side surface 78 of the housing side wall 80.

The impact members 46 project axially upwardly from the horizontal upper side surface 48 of impeller disc 32 (FIGS. 1 and 6) for a vertical distance sufficient to be certain that a least relatively large particles of material are engaged by an impact member during downward movement of the particles of material through a distance equal to the height of the impact members. The impact members 46 have leading side surfaces 108 which are perpendicular to the major horizontal upper side surface 48 of the impeller disc 32 (FIGS. 1 & 6). The time required for a particle of material to move vertically downwardly through a distance corresponding to the distance between a horizontal top side surface 106 of an impact member 46 to the horizontal upper side surface 48 of the impeller disc 32 is a function of the size and density of the particles of material and the downward velocity of the air which is moving around the impact member.

To provide for engagement of each of the particles of material with an impact member 46 during movement of the particles of material downwardly past the upper impeller disc 32, the vertical height of the impact member is at least as great as the distance which a particle can move downwardly during forward movement of an impact member through a distance equal to the space between adjacent impact members. Therefore, all relatively large particles will be exposed to at least one, and probably more, impactions during movement from a location above the impeller disc 32 to a location, there below.

The flow of air and particles of material conducted downwardly through the annular space 84 (FIGS. 2 and 3) moves into engagement with an upper side surface 94 of an annular deflector wall or cone 96. The deflector wall or cone 96 slopes radially inwardly and axially downwardly from the smooth cylindrical inner side surface 78 of the housing side wall 80. The deflector cone 96 directs the flow of air and particles of material radially inwardly toward the central portion of the next lower impeller disc 34.

The annular deflector cone 96 extends radially inwardly from the smooth cylindrical inner side surface 78 of the housing 14 for a distance of at least three inches past the peripheral edge portion 76 of impeller discs 34, 36 and 38, as measured in a horizontal plane. The deflector cone 96 advantageously slopes radially inwardly and axially downwardly at an angle of a least 10 degrees to the horizontal plane. The radially inward and axially downward slope of the upper side surface 94 of the deflector cone 96 promotes a smooth flow of air and particles of material from the annular space 84 and radially inwardly toward the central portion of the next lower impeller disc 34.

Air with particles of coal entrained therein, flows radially outward along the upper side surface 48 or 48*a* of the impeller discs 34 and 36. The air and particles of material then flow downwardly around the circular peripheral edge portions, either 76 or 76*a* of the impeller discs through the annular spaces, either 84 or 84*a*.

Air with particles of coal entrained therein, flows radially outwardly along the upper side surface 48*a* of the impeller disc 38. The air and particles of material then flow downwardly around the circular peripheral edge portion 76*a* of the impeller disc through the annular space 84*a* (FIG. 5).

On impeller disc 38, and possibly impeller discs 34 and 36, the clearance distance 88*a* is greater than clearance distance 102 (FIG. 7), to allow a momentary slowing of the air flow velocity and creation of an internal air classification zone.

The impact members 46*a* on the impeller disc 38, and possibly impeller discs 34 and 36, have multiple engagements with relatively heavy particles of material as the particles of material move downwardly from a level above the horizontal top surfaces 106*a* of the impact members 46*a* to the level of the upper side surface 48*a* of the impeller disc 38. The impact members 46*a* have sloping leading side surfaces 108*a* (FIGS. 1, 5 and 7) which slope upwardly and rearwardly in the direction opposite to the direction of rotation of the drive shaft 58. The upwardly and rearwardly sloping leading side surfaces 108*a* of the impact members 46*a* apply upwardly and forwardly directed force components against each of the particles which are engaged by the leading side surfaces 108*a* of the impact members 46*a*. This results in the relatively large particles of material being repeatedly engaged by the leading side surfaces 108*a* of the impact members 46*a* and hocked forwardly and upwardly. Therefore, the leading side surface 108*a* of one impact member 46*a* may repeatedly engage a particle and/or the particle may be engaged by the sloping leading side surfaces 108*a* of a plurality of impact members 46*a* on the impeller disc 38, and possibly impeller discs 34 and 36, before the particle moves downwardly through the annular space 84*a*.

The angle which the leading upper side surface 48*a* inscribes with the major horizontal upper side surface of impeller disc 38, and possibly impeller discs 34 and 36, is advantageously 85 degrees, or less. It is believed that an angle of 60 to 85 degrees may prove an optimum combination of forward and upward force components.

The slowed air velocity caused by the increased annular space 84*a* increases the time required for a particle of material to move vertically downwardly through a distance corresponding to the height of an impact member 46*a*. Therefore, large particles are allowed more time, thus enhancing the probability, to be affected by the shattering impact forces of the sloping leading side surfaces 108*a* of the impact members 46*a*; whereas, fine particles will generally pass through, since they are more affected by aerodynamic drag forces, and less by impact momentum forces.

The flow of air and particles of material conducted downwardly through the annular spaces 84 and 84*a* (FIGS. 3 and 5) moves into engagement with the upper side surface of the annular deflector cone 96. The deflector cone 96 slopes radially inwardly and axially downwardly from the smooth cylindrical inner side surface 78 of the housing side wall 80. The deflector cone 96 directs the flow of air and particles of material radially inwardly toward the central portion of the next lower impeller disc.

Drive Mechanisms and Fan

The impeller discs 32, 34, 36, and 38 are rotated by the drive shaft 58 at a speed which is sufficient to result in at least the large majority of particles of material being engaged at least once during downward movement of a particle of material from a level above the impeller discs 32, 34, 36 and 38 to the next level, therebelow. In fact, a relatively large particle which does not break upon initial engagement with an impact member 46 and 46*a* will probably be repeatedly engaged by impact members 46 and 46*a* on the upper side of the impeller discs 32, 34, 36 and 38 before the particle of material moves downwardly through the annular spaces 84 or 84*a* to the next level, therebelow.

A drive assembly 52 is operable to rotate the impeller discs 32, 34, 36, and 38 and impact members 46 and 46*a* about the central axis 40 of the chamber 42. As the impeller discs 32, 34, 36, and 38 and impact members 46 and 46*a* are rotated, air and material move downwardly from the inlet 16 through a vertical array 54 of impeller discs. As material moves downwardly through the array 54 of rotating impeller discs, the material is broken up or micronized to form small particles which are entrained in the downward flow of air. The downward flow of air transports material from one impeller disc 32, 34, or 36 to the next lower impeller disc in the array 54 of impeller discs.

Although four circular impeller discs 32, 34, 36, and 38 have been shown disposed in the vertical array 54 along a vertical central axis 40 of the cylinder chamber 42 in the housing 14, it is contemplated that either a greater or lesser number of impeller discs could be provided, if desired.

Although eight impact members 46 and 46*a* have been shown as being disposed on the upper side of each of the impeller discs 32, 34, 36, and 38, it is contemplated that either a greater or lesser number of impact members could be provided on any, or all, of each impeller disc, if desired.

The impeller discs 32, 34, 36, and 38 are connected with the vertical drive shaft 58 which forms part of the drive assembly 52. The drive shaft 58 has a central axis which is coincident with the vertical central axis 40 of the chamber 42 and the central axes of the impeller discs 32, 34, 36, and 38. A central portion of each of the impeller discs 32, 34, 36, and 38 is fixedly secured to the drive shaft 58 and rotates with the drive shaft about the central axis 40.

The drive assembly 52 includes a variable speed motor 62 which provides the power to rotate the drive shaft 58. The motor 62 is connected with the drive shaft 58 by belts 64. Although it is preferred to utilize belts to transmit power from the motor 62 to the drive shaft 58, other types of transmissions could be utilized. If desired, the motor 62 could be connected directly with the drive shaft 58.

A circular fan 70 is provided to promote a downward flow of air and material through the array 54 of impeller discs to a lower end portion of the chamber 42. The fan 70 is connected in fluid communication by a conduit 124 with the lower end portion of chamber 42. The air, with particles of material entrained therein, is conducted through the outlet conduit 124 to the fan 70 to the outlet 26.

As illustrated in FIG. 1, a separate drive assembly 128 is provided to drive the fan 70. The drive assembly 128 enables the fan 70 to be driven at any one of a plurality of speeds which are independent of the speed of rotation of the impeller discs 32, 34, 36, and 38. This enables the rate of flow of air and material from the upper end portion of the array 54 of impeller discs to be adjusted to any desired flow rate.

The drive assembly 128 includes a variable speed fan motor 130. The fan motor 130 is connected with the fan 70 by drive belts 132. If desired, the variable speed fan motor 130 could be connected directly to a fan drive shaft 134. The fan motor 130 can be operated at any desired speed within a range of speeds.

In the illustrated embodiment of the invention, the fan 70 is offset to one side of the array 54 of impeller discs. Thus, the fan drive shaft 134 and fan 70 have coincident horizontal central axes which extend perpendicular to and intersect the vertical central axis of the impeller disc drive shaft 58. However, the fan 70 and fan drive shaft 134 could have a different orientation if desired. Thus, if desired, the fan 70 and fan drive shaft 134 could be rotated about an axis which is skewed at an acute angle to the central axis of the impeller disc drive shaft 58. If desired, the fan 70 could be mounted in a coaxial relationship with the drive shaft 58 and impeller discs 32, 34, 36, and 38.

The speed of operation of the impeller disc drive motor 62 can be selected to optimize the rate of rotation of the impeller discs 32, 34, 36, and 38 and impact members 46 and 46*a* relative to the housing side wall 80 of the housing 14. The speed of operation of the fan motor 130 can be selected to optimize the rate of flow of air from the inlet 16 downwardly through the array 54 of impeller discs to the outlet conduit 28. Thus, the speed of operation of the impeller disc drive assembly 52 is adjustable independently of the speed of operation of the fan drive assembly 128.

If desired, a single motor could be provided to drive both the fan 70 and impeller disc drive shaft 58. If this was done, a variable speed transmission would be provided between the single motor and the fan drive shaft 134.

A stirrer assembly 138 is disposed beneath the vertical array 54 of impeller discs and is effective to agitate particles of material in the lower portion of the chamber 42. In addition, the stirrer assembly 138 moves particles of material through the outlet conduit 124 to the fan 70.

Thus, the stirrer assembly 138 includes a plurality of blades 140 which are connected with the drive shaft 58 for rotation therewith. The rotating blades 140 move particles of material radially outward toward the housing side wall 80 and moves the particles of material along the side wall 80 to the outlet conduit 124 leading to the fan 70.

Rotation of the blades 140 moves the particles of material which are adjacent to a circular lower end wall 142 of the housing 14. By agitating the particles of materials in the lower end portion of the chamber 42, the stirrer assembly promotes entrainment of the particles in a flow of air end particles being conducted to the fan 70.

Air Deflector Plates

It is believed, that as material input rates increase within the micronizer apparatus 10, localized frictional losses within the apparatus also increase due to the corresponding density increase of the combined pulverulent air-coal mixture. These localized frictional losses are most evident in the region closely above the annular spaces 84 and 84*a*, due to the extreme air shear forces and turbulence caused by the rapidly moving leading side surfaces 108 and 108*a* of the rapidly rotating impact members 46 and 46*a*.

As air flow moves toward and through annular spaces 84 and 84*a*, its vertically downward moving aerodynamic drag force component can become insufficient to overcome the localized frictional losses caused by the rapidly rotating impact members 46 and 46*a*. This can result in a momentary buildup or clogging of material within the annular region closely adjacent to the cylindrical inner side surface 78 and above the horizontal plane inscribed by the rotating top surfaces 106 and 106*a* of impactors 46 and 46*a*.

Concurrently, horizontal centrifugal force components within this localized annular region can further cause a concentration of oversized particles to buildup closely adjacent to the cylindrical inner side surface 78 and above the horizontal plane inscribed by the rotating top surfaces 106 and 106*a*.

During the momentary buildup of oversized material within this localized annular region, the concentration of material increases; which conversely, causes an increase in the density of combined pulverulent air-coal mixture within the localized annular region. It is believed, that within a very brief period of time, the density of combined pulverulent becomes sufficient to cause a gravitational downward force vector, which when combined with the air flow's vertically downward moving aerodynamic drag force component, becomes sufficient to overcome the localized frictional losses. The result is a cyclic pulsation; which includes: material buildup, followed by material release, followed by material buildup, followed by material release, and so forth.

During the release phase of the cyclic pulsation, it is believed that a portion of the oversized material, which was concentrated during the cyclic buildup, can move vertically downward through the clearance space between the outer end portions 100 and 100*a* of impactors 46 and 46*a*, and the cylindrical inner side surface 78, without being touched by impactors 46 or 46*a*.

To prevent the cyclic buildup and clogging problem from occurring within this invention, a plurality of identical air deflector plates 150 are fixedly attached to the bottom side surface of the deflector cones 96. The air deflector plates 150 deflect the combined pulverulent air-coal mixture downwardly and inwardly toward the rotating impactors 46 and 46*a* by creating a vertical force component from the, otherwise predominant horizontally oriented, centrifugal force field that prevails in the annular region closely adjacent to the cylindrical inner side surface 78 and above the horizontal plane inscribed by the rotating top surfaces 106 and 106*a* (FIGS. 6 & 7).

It is believed that two to six air deflector plates 150 fixedly attached to the bottom side surface of deflector cones 96 and above impeller discs 34, 36 and 38 may prove an optimal combination.

The top edge portion 156 of the air deflector plate 150 is fixedly connected to bottom side surface of deflector cone 96.

The bottom edge portion 152 of the air deflector plate 150 extends horizontally and substantially radially inward from the cylindrical inner side surface 78 of the housing side wall 80 for at least three inches past the peripheral edge portions 76 and 76*a* of the impeller discs 34, 36 and 38 as measured in a horizontal plane, but slanted toward the direction of rotation of the drive shaft 58 more than zero, but less than 30 degrees, as measured in a horizontal plane.

The outer edge portion 154 of the air deflector plate 150 extends axially and substantially downward from the bottom side surface of the deflector cones 96 to approximately one half to one inch above the horizontal top surfaces 106 and 106*a* of impact members 46 and 46*a* and sloped toward the direction of rotation of the drive shaft 58 more than 10 degrees, but less than 45 degrees, as measured in a vertical plane.

What is claimed is:

1. An apparatus for pulverizing coal to produce micronized coal, said apparatus comprising a housing having a sidewall with a cylindrical inner side surface, a plurality of circular impeller discs disposed in an array along a vertical central axis of said cylindrical inner side surface, each of said impeller discs having a horizontal upper major side surface, which extends perpendicular to the vertical central axis of the cylindrical inner side surface of said housing, each of said impeller discs having a circular peripheral edge portion which is coaxial with and is spaced from the cylindrical inner side surface of said housing, a plurality of impact members disposed on an upwardly facing major side surface of each of said impeller discs, drive shaft means connected with said plurality of impeller discs, and motor means for rotating said drive shaft means to rotate said impeller discs and move each of said impact members through a distance equal to a distance between said impact members in less time than is required for a particle of coal to move downward in said apparatus through a distance equal to the distance from the upper side of an impact member to an upwardly facing major side surface of an impeller disc to enable particles of coal to be engaged by said impact members on said impeller discs, each of said impact members on one of said impeller discs extending radially outward from the circular peripheral edge portion of said one of said impeller discs to all outer end portion which is spaced from the cylindrical inner side surface of said housing, each of said impact members on said one of said impeller discs having an upper side surface which is disposed above the upwardly facing major side surface of said one of said impeller discs, each of said impact members on said one of said impeller discs has a leading side surface which slopes upward from the upwardly facing major side surface of said one of said impeller discs and which slopes rearward in a direction opposite to the direction of rotation of said one of said impeller discs at an angle of 85° or less to a horizontal plane.

2. An apparatus as set forth in claim 1 further including a plurality of annular deflectors each of which is disposed beneath and is spaced apart from an impeller disc of said plurality of impeller discs, each of said annular deflectors having a circular radially outer edge portion fixedly connected to said housing and a circular radially inner edge portion which is spaced from the cylindrical inner side surface of said housing and is disposed beneath a downwardly facing horizontal major side surface of an impeller disc, each of said deflectors having an annular upwardly facing side surface which extends between said radially inner and outer edge portions, said annular upwardly facing side surface sloping radially inward and downward at an angle of at least 10 degrees to a horizontal plane.

3. An apparatus as set forth in claim 2 further including fan means and means for driving said fan means at any one of a plurality of speeds to promote a flow of air and coal downwardly along said array of impeller discs and to promote a flow of air and coal from said housing.

4. An apparatus as set forth in claim 1 further including fan means disposed adjacent to and connected in fluid communication with a lower end portion of said array of impeller discs for promoting a flow of air and micronized coal from said housing and motor means for driving said fan means at a speed which is independent of the speed of rotation of said drive shaft means.

5. An apparatus as set forth in claim 4 further including a rotatable member disposed between the lower end portion of said array of impeller discs and said fan means and means for rotating said rotatable member.

6. An apparatus as set forth in claim 1 wherein said housing includes means for defining a single opening adjacent to an upper end portion of said array of impeller discs and through which all of the coal to be micronized and all of the air for use in transporting particles of coal downwardly along said array of impeller discs enters said housing.

7. An apparatus for use in pulverizing materials, said apparatus comprising a housing having surface means for defining a chamber having a vertical central axis, a plurality of impeller discs disposed in an array along the vertical central axis of said chamber, impact members disposed on said impeller discs for impacting against the material to be pulverized, said housing having inlet means disposed adjacent to an upper end portion of said array of impeller discs and through which air and materials to be pulverized enter said chamber, said housing having outlet means disposed adjacent to a lower end portion of said array of impeller discs and through which a flow of air with particles of pulverized material entrained therein is conducted from said chamber, first drive means for rotating said impeller discs relative to said housing to pulverize material as the material moves downwardly from the upper end portion of said array of impeller discs to the lower end portion of said array of impeller discs, fan means for promoting a downward flow of air from the upper end portion of said array of impeller discs toward the lower end portion of said array of impeller discs to promote a downward flow of material from the upper end portion of said array of impeller discs toward the lower end portion of said array of impeller discs, and second drive means connected with said fan means for driving said fan means at any one of a plurality of speeds which are different than the speed of rotation of said impeller discs to enable the rate of flow of air and material from the upper end portion of said array of impeller discs toward the lower end portion of said array of impeller discs to be varied without varying the speed of rotation of said impeller discs.

8. An apparatus as set forth in claim 7 wherein said surface means for defining a chamber having a vertical central axis includes means for defining a cylindrical side surface of said chamber, said cylindrical side surface of said chamber having a central axis which is coincident with the vertical central axis of said chamber, each of said impeller discs having a horizontal upper major side surface which extends perpendicular to the vertical central axis of the cylindrical side surface of said chamber, each of said impeller discs having a peripheral edge portion which is coaxial with and is spaced from the cylindrical inner side surface of said housing throughout the extent of said circular peripheral edge portion of each of said impeller discs to enable air and material to move between the circular peripheral edge portion of the impeller discs and the cylindrical inner side surface of said housing, a plurality of said impact members extending radially outwardly from the circular peripheral edge portion of one of said impeller discs to an outer end portion which is spaced from the cylindrical inner side surface of said housing.

9. An apparatus as set forth in claim 7 wherein said second drive means includes variable speed motor means connected with said fan means.

10. An apparatus as set forth in claim 7 wherein said fan means includes a fan and means for supporting said fan for rotation about an axis which extends transversely to the vertical central axis of said chamber.

11. An apparatus as set forth in claim 7 wherein said first drive means includes a first motor and means for connecting said first motor means with said impeller discs, said second drive means including a second motor and means for connecting said second motor means with said fan means.

12. An apparatus as set forth in claim 7 further including a plurality of annular deflectors each of which is disposed beneath and is spaced apart from one of said impeller discs, each of said annular deflectors having a circular radially outer edge portion fixedly connected to said housing and a circular radially inner edge portion, each of said deflectors having an annular upwardly facing side surface which extends between said radially inner and outer edge portions.

13. An apparatus for use in pulverizing coal to produce micronized coal, said apparatus comprising a housing having surface means for defining a chamber having a vertical central axis, a plurality of impeller discs disposed in an array along the vertical central axis of said chamber, impact members disposed on said impeller discs for impacting against particles of coal, means for rotating said impeller discs to engage the coal with said impact members, fan means for promoting a downward flow of air from an upper end portion of the array of impeller discs toward a lower end portion of the array of impeller discs, and means for rotating said fan means at a speed which is different than the speed of rotation of said impeller discs.

14. An apparatus as set forth in claim 13 wherein said means for rotating said impeller discs includes a first motor and means for connecting said first motor with said impeller discs, said means for rotating said fan means includes a second motor and means for connecting said second motor with said fan means.

15. An apparatus as set forth in claim 13 wherein fan means is rotatable about an axis which is perpendicular to the vertical axis of the chamber.

16. An apparatus for use in pulverizing coal, said apparatus comprising a housing having surface means for defining a chamber having a vertical central axis, a plurality of impeller discs disposed in an array along the vertical central axis of said chamber, impact members disposed on said impeller discs for impacting against the coal, said housing having inlet means disposed adjacent to an upper end portion of said array of impeller discs and through which air and coal to be pulverized enter said chamber, said housing having outlet means disposed adjacent to a lower end portion of said array of impeller discs and through which a flow of air with particles of pulverized coal entrained therein is conducted from said chamber, a plurality of annular deflector walls each of which is disposed beneath and is spaced apart from one of said impeller discs, a first deflector wall of said plurality of deflector walls being disposed beneath a first impeller disc of said plurality of impeller discs, said first deflector wall having a circular radially outer edge portion fixedly connected with said housing adjacent to a circular peripheral edge portion of said first impeller disc and a circular radially inner edge portion which is disposed beneath said first impeller disc and has a diameter which is less than a diameter of said circular peripheral edge portion of said first impeller disc, said first deflector wall having an annular upwardly facing side surface which extends between said radially inner and outer edge portions of said first deflector wall and which engages a downward flow of air and particles of coal from the peripheral edge portion of said first impeller disc and directs the downward flow of air and particles of coal from the peripheral edge portion of said first impeller disc toward a central portion of a second impeller disc of said plurality of impeller discs, said first deflector wall having an annular downwardly facing side surface which extends between said radially inner and outer edge portions of said first deflector wall, and a plurality of deflector plates which extend downward from the downwardly facing side surface of said first deflector wall, a first deflector plate of said plurality of deflector plates having a side surface which extends downward from an upper edge portion of said first deflector plate and from said downwardly facing side surface of said first deflector wall at a location adjacent to said radially outer edge portion of said first deflector wall and to said housing to a lower edge portion of said first deflector plate, said lower edge portion of said first deflector plate being disposed adjacent to upper portions of impact members disposed on said second impeller disc during rotation of said second impeller disc relative to said housing.

17. An apparatus as set forth in claim 16 wherein said surface means for defining a chamber defines a generally cylindrical chamber having a substantially uniform diameter throughout the axial extent of the array of impeller discs, said circular peripheral edge portion of said first impeller disc having a diameter which is greater than a diameter of a circular peripheral edge portion of said second impeller disc, said circular peripheral edge portion of said second impeller disc having a diameter which is greater than a diameter of said circular radially inner edge portion of said first deflector wall.

18. An apparatus as set forth in claim 17 wherein impact members of said plurality of impact members disposed on said first impeller disc have end portions which are disposed adjacent to said circular peripheral edge portion of said first impeller disc, said impact members disposed on said second impeller disc have end portions which extend radially outward of a circular peripheral edge portion of said second impeller disc.

19. An apparatus as set forth in claim 16 wherein said annular upwardly facing side surface of said first deflector wall slopes radially inward and downward at an angle of at least 10 degrees to a horizontal plane.

20. An apparatus as set forth in claim 16 further including first drive means for rotating said impeller discs relative to said housing to pulverize coal as the coal moves downwardly from the upper end portion of said array of impeller discs to the lower end portion of said array of impeller discs, fan means for promoting a downward flow of air from the upper end portion of said array of impeller discs toward the lower end portion of said array of impeller discs to promote a downward flow of coal from the upper end portion of said array of impeller discs toward the lower end portion of said array of impeller discs, and second drive means connected with said fan means for driving said fan means at any one of a plurality of speeds which are different than the speed of rotation of said impeller discs to enable the rate of flow of air and coal from the upper end portion of said array of impeller discs toward the lower end portion of said array of impeller discs to be varied without varying the speed of rotation of said impeller discs.

21. An apparatus as set forth in claim 20 wherein said surface means for defining a chamber having a vertical central axis includes means for defining a cylindrical side surface of said chamber, said cylindrical side surface of said chamber having a central axis which is coincident with the vertical central axis of said chamber, each of said impeller discs having a horizontal upper major side surface which extends perpendicular to the vertical central axis of the cylindrical side surface of said chamber, each of said impeller discs having a peripheral edge portion which is coaxial with and is spaced from the cylindrical inner side surface of said chamber throughout the extent of said circular peripheral edge portion of each of said impeller discs to enable air and coal to move between the circular peripheral edge portion of the impeller discs and the cylindrical inner side surface of said chamber.

22. An apparatus as set forth in claim 20 wherein said second drive means includes variable speed motor means connected with said fan means.

23. An apparatus for pulverizing coal to produce micronized coal, said apparatus comprising a housing having a sidewall with a cylindrical inner side surface, a plurality of circular impeller discs disposed in an array along a vertical central axis of said cylindrical inner side surface, each of said impeller discs having a horizontal upper major side surface which extends perpendicular to the vertical central axis of the cylindrical inner side surface of said housing, each of said impeller discs having a circular peripheral edge portion which is coaxial with and is spaced from the cylindrical inner side surface of said housing, said plurality of impeller discs including an upper impeller disc which is disposed at an upper end of said array of impeller discs and a lower impeller disc which is disposed at a lower end of said array of impeller discs, said circular peripheral edge portion of said upper impeller disc being spaced a first distance from said cylindrical inner side surface of said housing, said circular peripheral edge portion of said lower impeller disc being spaced a second distance from said cylindrical inner side surface of said housing, said second distance being greater than said first distance, a plurality of impact members disposed on an upwardly facing major side surface of each of said impeller discs, each of said impact members on said upper impeller disc extending to the circular peripheral edge portion of said upper impeller disc and having an outer end which is adjacent to the cylindrical side surface of said housing, each of said impact members on said lower impeller disc extending radially outwardly from the circular peripheral edge portion of said lower impeller disc to an outer end portion which is adjacent to the cylindrical inner side surface of said housing, said outer end portions of said impact members on said upper and lower impeller discs being spaced the same distance from the cylindrical inner side surface of said housing.

24. An apparatus as set forth in claim 23 wherein each of said impact members on said lower impeller disc has a leading side surface which slopes upwardly from an upwardly facing major side surface of said lower impeller disc and which slopes rearwardly in a direction opposite to a direction of rotation of said lower impeller disc.

25. An apparatus as set forth in claim 23 further including a plurality of annular deflector walls each of which is disposed beneath and is spaced apart from one of said impeller discs, each of said annular deflector walls having a circular radially outer edge portion fixedly connected to said housing and a circular radially inner edge portion which is spaced from the cylindrical inner side surface of said housing, said circular radially inner edge portion of each of said deflector walls having a diameter which is less than the diameter of said lower impeller disc.

26. An apparatus as set forth in claim 25 wherein each of said deflector walls has an annular upwardly facing side surface which extends between said radially inner and outer edge portions, said annular upwardly facing side surface sloping radially inwardly and downwardly at an angle of at least 10 degrees to a horizontal plane.

27. An apparatus as set forth in claim 25 further including a plurality of deflector plates which extend downward from at least some of said deflector walls, each of said deflector plates having a side surface which extends downward from an upper edge portion of one of said deflector walls at a location adjacent to the radially outer edge portion of said one deflector wall and to a lower edge portion, said lower edge portion of each of said deflector plates being disposed adjacent to upper portions of impact members disposed on an impeller disc of said plurality of impeller disc.

28. An apparatus as set forth in claim 23 further including fan means and means for driving said fan means at anyone of a plurality of speeds to promote a flow of air and coal downwardly along said array of impeller discs and to promote a flow of air and coal from said housing.

29. An apparatus as set forth in claim 23 further including fan means disposed adjacent to and connected in fluid communication with a lower end portion of said array of impeller discs for promoting a flow of air and micronized coal from said housing and motor means for driving said fan means at a speed which is independent of the speed of rotation of said impeller discs.

30. An apparatus as set forth in claim 29 further including a rotatable member disposed between the lower end portion of said array of impeller discs and said fan means and means for rotating said rotatable member.

31. An apparatus for use in pulverizing coal, said apparatus comprising a housing having surface means for defining a chamber having a vertical central axis and a cylindrical inner side surface, a plurality of rotatable impeller discs disposed in an array along the vertical central axis of said chamber, impact members disposed on said impeller discs for impacting against the coal, each of said impeller discs having a horizontal upper major side surface which extends perpendicular to the vertical central axis of the cylindrical inner side surface of said housing, each of said impeller discs having a circular peripheral edge portion which is coaxial with and is spaced from the cylindrical inner side surface of said housing, said plurality of impeller discs including an upper impeller disc which is disposed at an upper end of said array of impeller discs and a lower impeller disc which is disposed at a lower end of said array of impeller discs, said circular peripheral edge portion of said upper impeller disc being spaced a first distance from said cylindrical inner side surface of said housing, said circular peripheral edge portion of said lower impeller disc being spaced a second distance from said cylindrical inner side surface of said housing, said second distance being greater than said first distance, each of said impact members on said upper impeller disc extending to the circular peripheral edge portion of said upper impeller disc and having an outer end which is adjacent to the cylindrical inner side surface of said housing, each of said impact members on said lower impeller disc extending radially outwardly from the circular peripheral edge portion of said lower impeller disc to an outer end portion which is adjacent to the cylindrical inner side surface of said housing, said outer end portions of said impact members on said upper and lower impeller discs being spaced the same distance from the cylindrical inner side surface of said housing, each of said impact members on said lower impeller disc having a leading side surface which slopes upwardly from an upwardly facing major side surface of said lower impeller disc and which slopes rearwardly in a direction opposite to a direction of rotation of said lower impeller disc at an angle of 85 degrees or less to a horizontal plane, said housing having inlet means disposed adjacent to an upper end portion of said array of impeller discs and through which air and coal to be pulverized enter said chamber, said housing having outlet means disposed adjacent to a lower end portion of said array of impeller discs and through which a flow of air with particles of pulverized coal entrained therein is conducted from said chamber, first drive means connected with said impeller discs for rotating said impeller discs about the vertical central axis of said chamber, fan means rotatable about a horizontal axis to promote a downward flow of air and coal from the upper end portion of said array of impeller discs to the lower end portion of said array of impeller discs, second drive means connected with said fan means for rotating said fan means at a speed which is independent of the speed of rotation of said impeller discs, a plurality of annular deflector walls each of which is disposed beneath and is spaced apart from one of said impeller discs, a first deflector wall of said plurality of deflector walls being disposed beneath said upper impeller disc of said plurality of impeller discs, said first deflector wall having a circular radially outer edge portion fixedly connected with said housing adjacent to a circular peripheral edge portion of said upper impeller disc and a circular radially inner edge portion which is disposed beneath said upper impeller disc and has a diameter which is less than a diameter of said circular peripheral edge portion of said upper impeller disc, said first deflector wall having an annular upwardly facing side surface which extends between said radially inner and outer edge portions of said first deflector wall and which engages a downward flow of air and particles of coal from the peripheral edge portion of said upper impeller disc and directs the downward flow of air and particles of coal from the peripheral edge portion of said first impeller disc toward a central portion of a second impeller disc disposed beneath said upper impeller disc, said annular upwardly facing side surface of said first deflector wall sloping radially inward and downward at an angle of at least 10 degrees to a horizontal plane, said first deflector wall having an annular downwardly facing side surface which extends between said radially inner and outer edge portions of said first deflector wall, and a plurality of deflector plates which extend downward from the downwardly facing side surface of said first deflector wall, a first deflector plate of said plurality of deflector plates having a side surface which extends downward from an upper edge portion of said first deflector plate and from said downwardly facing side surface of said first deflector wall at a location adjacent to said radially outer edge portion of said first deflector wall and to said housing to a lower edge portion of said first deflector plate, said lower edge portion of said first deflector plate being disposed adjacent to upper portions of impact members disposed on the impeller disc disposed beneath said upper impeller disc during rotation of said impeller disc relative to said housing.

* * * * *